US006363549B2

(12) United States Patent
Humpert et al.

(10) Patent No.: US 6,363,549 B2
(45) Date of Patent: Apr. 2, 2002

(54) FAUCET SYSTEM FOR SANITARY FIXTURES

(75) Inventors: Jürgen Humpert, Hemer; Eckhard Gransow, Fröndenberg, both of (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 09/777,123

(22) Filed: Feb. 5, 2001

(30) Foreign Application Priority Data

Feb. 9, 2000 (DE) ..... 10005961

(51) Int. Cl.[7] ..... E03C 1/05

(52) U.S. Cl. ..... 4/623; 4/668; 4/677; 251/129.04; 251/129.03

(58) Field of Search ..... 4/623, 668, 676, 4/675, 677; 251/129.04, 129.03; 137/625.17

(56) References Cited

U.S. PATENT DOCUMENTS 4,406,398 A * 9/1983 Perkins ..... 236/12.15
4,604,764 A * 8/1986 Enzo ..... 4/623
4,688,277 A * 8/1987 Kakimoki et al. ..... 4/623
4,995,585 A * 2/1991 Gruber et al. ..... 251/30.03
5,092,560 A * 3/1992 Chen ..... 251/30.03
5,397,099 A * 3/1995 Pilolla ..... 251/129.03
5,595,216 A * 1/1997 Pilolla ..... 137/607
5,893,387 A * 4/1999 Paterson et al. ..... 137/359
6,003,170 A 12/1999 Humpert
6,044,865 A * 4/2000 Kreitmayr et al. ..... 137/607

FOREIGN PATENT DOCUMENTS

DE 197 23 312 12/1998

* cited by examiner

*Primary Examiner*—Robert M. Fetsuga
*Assistant Examiner*—Huyen Le
(74) *Attorney, Agent, or Firm*—Herbert Dubno

(57) ABSTRACT

A valve system in which a magnetic valve is in series with a manually-operated valve and contact with the handle of the manually-operated valve initiates flow via the electronic controller whereas, upon loss of contact, a proximity detector controls the magnetic valve when an object, such as a user's hand, is in range. The manual contact is superordinate and proximity detection is subordinate and the proximity detector remains permanently switched on during the operating duration.

10 Claims, 3 Drawing Sheets

FAUCET SYSTEM FOR SANITARY FIXTURES

FIELD OF THE INVENTION

Our present invention relates to a valve system for a sanitary fixture, for example a faucet for a washbasin or the like, with a manually-controlled valve having a handle and a further valve controlled by electronic circuitry, the two valves being provided in series and the control circuitry having a proximity detector.

1. Background of the Invention

A faucet system of the type described is found in German patent document DE 197 23 312 A1 and U.S. Pat. No. 6,003,170. In this system, the manually-controlled valve serves for initiating and terminating water flow, control of the temperature and control of the flow rate and upon it is superimposed an electrical control utilizing a detecting device which is switched in and out.

While that system has been found to be satisfactory, it is capable of further simplification.

2. Objects of the Invention

It is therefore the principal object of the present invention to provide an improved valve system or faucet arrangement with the advantages of the prior art system but which is further simplified.

Another object of the invention is to provide a faucet system for sanitary fixtures, including but not limited to wash basins and the like, utilizing a proximity detector responding to an object, e.g. a hand of the user, in the range of the detector and which affords reliable control of the faucet.

SUMMARY OF THE INVENTION

These objects and others which will become apparent hereinafter are attained, in accordance with the invention in a system in which a manually-controlled valve is provided in series with an electrically-controlled valve, an electronic controller is provided for the electrically-controlled valve and the system includes a sensor for contact of the user with the handle of the faucet and a proximity detector for detecting the presence of an object in a range of that detector.

According to the invention the sensor on the handle of the faucet is superordinate in hierarchy of control of the electrically-controlled valve while the proximity detector is subordinate in that hierarchy so that only during the period of contact with the handle by the user is the electrically-controlled valve held in its open position by the electronic controller while that electrically-controlled valve responds to the detection device only when the handle of the faucet is not in contact with the hand of the user. The detection device, however, remains enabled during the entire operating period or interval of the faucet.

More particularly, the valve system or faucet system of the invention can comprise:

- a manually controlled valve having a handle for controlling flow between an inlet and an outlet;
- an electrically controlled valve hydraulically in series with the manually controlled valve and openable to permit flow through the manually controlled valve and closable to limit flow through the manually controlled valve;
- a contactless proximity detector responsive to presence of an object in a vicinity of the manually controlled valve;
- a contact sensor responsive to contact of the handle by a hand of a user; and

- an electronic controller connected to the electrically controlled valve, the proximity detector and the contact sensor and constructed and arranged so that:
  - the sensor is hierarchically superordinate to the detector and maintains the electrically controlled valve open as long as there is contact with the handle by the hand of the user,
  - the detector is hierarchically subordinate to the sensor and maintains the electrically controlled valve open even in an absence of contact with the handle by the hand of the user, and
  - the detector is continuously activated i.e. is permanently in an enabled state ready to detect an object in its range.

According to a feature of the invention, the manually-controlled or first valve controlled by the handle, is a mixing and flow-control valve while the second or electrically-controlled valve has an electromagnetically-controlled pilot valve. The electrically-controlled valve is advantageously provided upstream of the manually-controlled valve and can include two valve units for the hot and cold water respectively, preferably embodied in a single valve housing with a twin valve, controlled by the electromagnetic pilot valve. The electrically-controlled valve can be provided with or in series with check valves preventing backflow and/or dirt-blocking screens in the lines for the hot and cold water.

The aforementioned features allow a significant simplification of a faucet system in that the manually-operated valve handle itself requires only the contact sensor. It has been found that electronic circuitry utilizing a proximity detector is substantially more economical if it is utilized continuously, i.e. when the proximity sensor remains in an enabled state continuously. With the system of the invention, the proximity sensor is enabled or activated and thus in an activated state continuously.

While in a preferred state the valve operated by the control circuit is located upstream of the manually-operated valve, it is possible to provide the electrically-operated valve downstream of the manually-operated valve and between the outlet and the manually-operated valve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
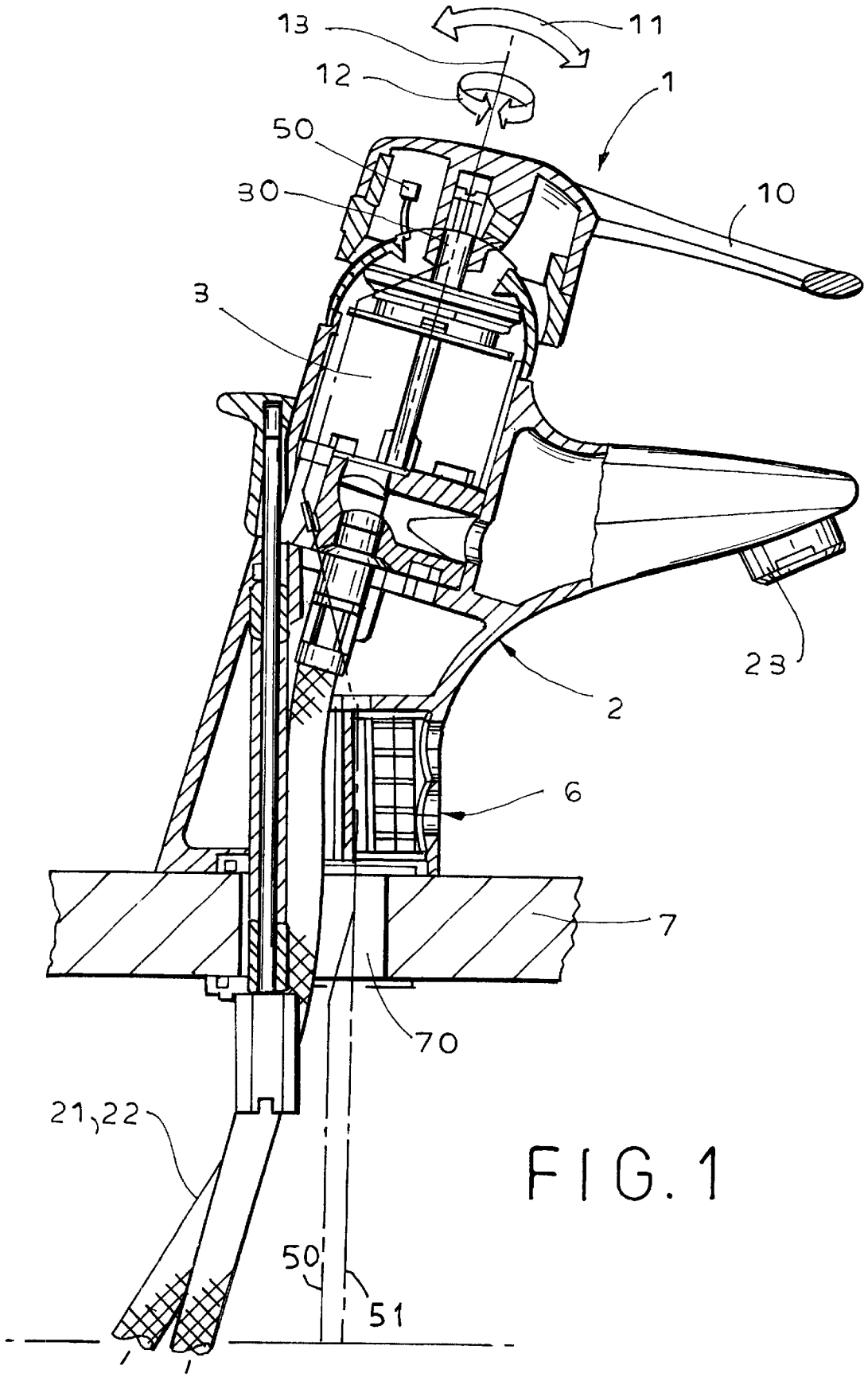
FIG. 1 is a cross sectional view of a washbasin provided with a faucet system according to the invention.
Figure 1:
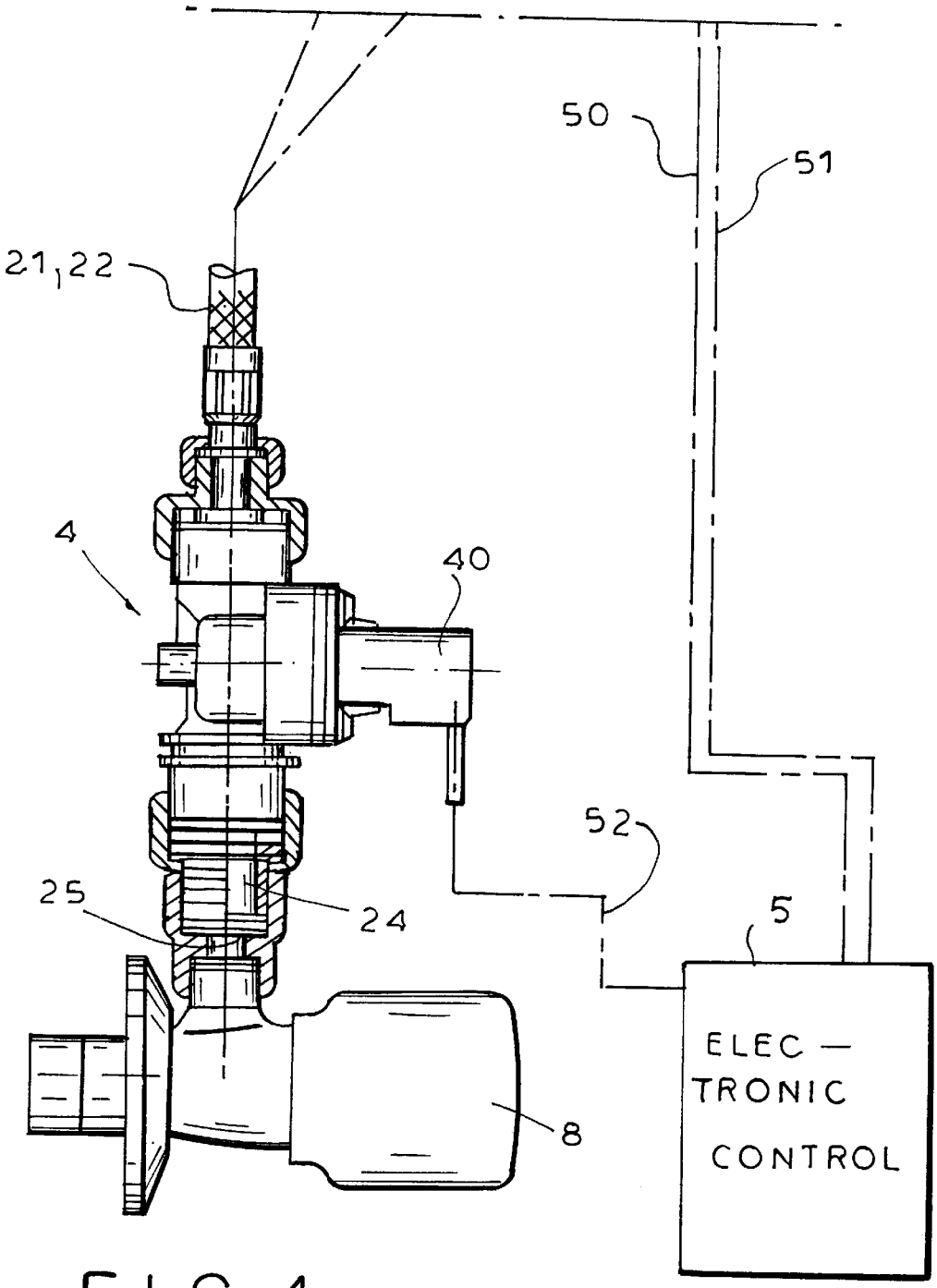

In FIG. 1, the washbasin 7 is provided with a bore 70 above which the faucet body 6 is mounted.

The faucet body forms a housing receiving a mixing cartridge 3 which serves to mix hot and cold water supplied by the connecting lines 21 and 22 and to control the rate of flow of the mixed-temperature water from the spigot 23. The connecting lines 21 and 22 pass through the opening 70 into the valve body 2.

The cartridge 3 of the manually-operated valve is connected by a positioning lever 30 with a handle 1, the manually-operated valve being of the single handle type. A pivoting movement of the handle about a perpendicular to the central axis 13 in the direction of arrow 11 controls the rate of flow from the spigot and represents a first degree of freedom for this valve. A pivotal movement of the handle 1 about the central axis 13 as represented by the double-headed arrow 12 controls the mixing ratio of cold and hot water.

In a lower part of the body 2 of the manually-operated faucet is a detection device 6, referred to here as a proximity detector which can ascertain whether an object, e.g. the hand of a user, is within a certain detection range, usually close enough to the flow from the spigot 23 to enable washing of the hands or other activity in the basin.

In addition, the handle 1, in the region of the handle arm 10 has a sensor 100 on its surface which can detect a contact with the handle by the hand of the user. The sensor 100 is connected by a conductor 50 and the detector 6 is connected by a conductor 51 with the electronic control circuitry 5 disposed beneath the washbasin.

The connection pipes 21 and 22 are provided with elbow valves 8 for the hot and cold water and connected to the hot and the cold networks of the building. In the drawing, only one elbow valve has been shown, the second elbow valve being provided behind the one illustrated and behind the drawing plane.

Downstream of the elbow valve, each of the lines is provided with a dirt-collecting screen 25 and the check valve or backflow preventer 24 each of which communicates with a respective valve unit in a twin valve structure of the electrically-controlled valve 4 which is represented diagrammatically in the drawing. In other words, the valve 4 with its electromagnetically-controlled pilot valve 40, as separate valve units for the hot and cold water which are both shut off when the pilot valve 40 is de-energized and are both opened when the pilot valve is energized. Of course, the pilot valve 40 need not be of the type which is closed when de-energized but can be a bistable valve which is energized to open and energized again to close. The pilot valve 40 is connected by an electric line 52 with the electronic control 5.

The electronic control 5 is so programmed that it operates continuously and provides a hierarchical response to actuation of the sensor 100 and the proximity detector 6. In other words the contact with the sensor 100 produces a signal which is superordinate while the proximity detector 6 provides a signal which is subordinate in control of the pilot valve 40. The electrical energy supply for the electronic circuitry 5, the detection device 6 and the pilot valve 40 is one or more batteries in the control unit 5. Of course it is also possible to have the control unit 5 connected to an electric supply network.

The faucet system operates substantially as follows.

In the position of the handle 1 shown in FIG. 1, the first valve 3 is in its closed position. Since the sensor 100 is not touched by the user, the electronic control 5 maintains the pilot valve 40 of the second valve (twin valve) in a closed position.

If a user contacts the sensor, e.g. by engaging the handle 1, the electronic control 5 activates the pilot valve 40 which opens the twin valve 4 and holds the latter open as long as the user is in contact with the sensor 100.

In this state, the user can employ the faucet under the control of the handle to dispense the requisite volume rate of flow of the water at the desired temperature. By a pivoting of the handle 1 in the direction of the arrow 11, the valve 3 is moved increasingly from its blocking position into the fully open position so that more water emerges from the spigot 23 as a free stream. By a rotation of the handle 1 in the direction of arrow 12, the mixing ratio of cold and hot water and thus the temperature of the emerging stream can be regulated. If the user loses contact with the sensor 100 in an open position of the valve 3, the detection device 6 takes over control of the pilot valve via the control 5. If there is, therefore, an object in the range of the detector 6, the electronic control 5 retains the pilot valve 40 and the twin valve 4 in its open position. If no object is detected, the electronic controller 5 closes the pilot valve. If at a later point an object is introduced into the range of the detector 6, the electronic circuit 5 energizes the pilot valve 40 to again open the twin valve 4 for the duration that an object remains in the detection range. The faucet then operates as a contactless automatic flow faucet.

In the embodiment illustrated, the second valve 4 is formed as a twin valve upstream of the manually-controlled valve 3 and can either have two pilot valves, one for each valve unit, or a single pilot valve for both units, i.e. for the hot and cold water. Instead of two magnetically-controlled valve units, at the downstream side of the pilot valve a single magnetic valve can be provided. The electric circuitry can be provided together with a proximity detector in the valve body and the proximity detector can be an infrared light proximity switch. The invention of course is also applicable to a water tap type of faucet in which the manually-operated valve only controls the on and off state and acts as a flow controller without affecting the flow temperature.

Figure 2:
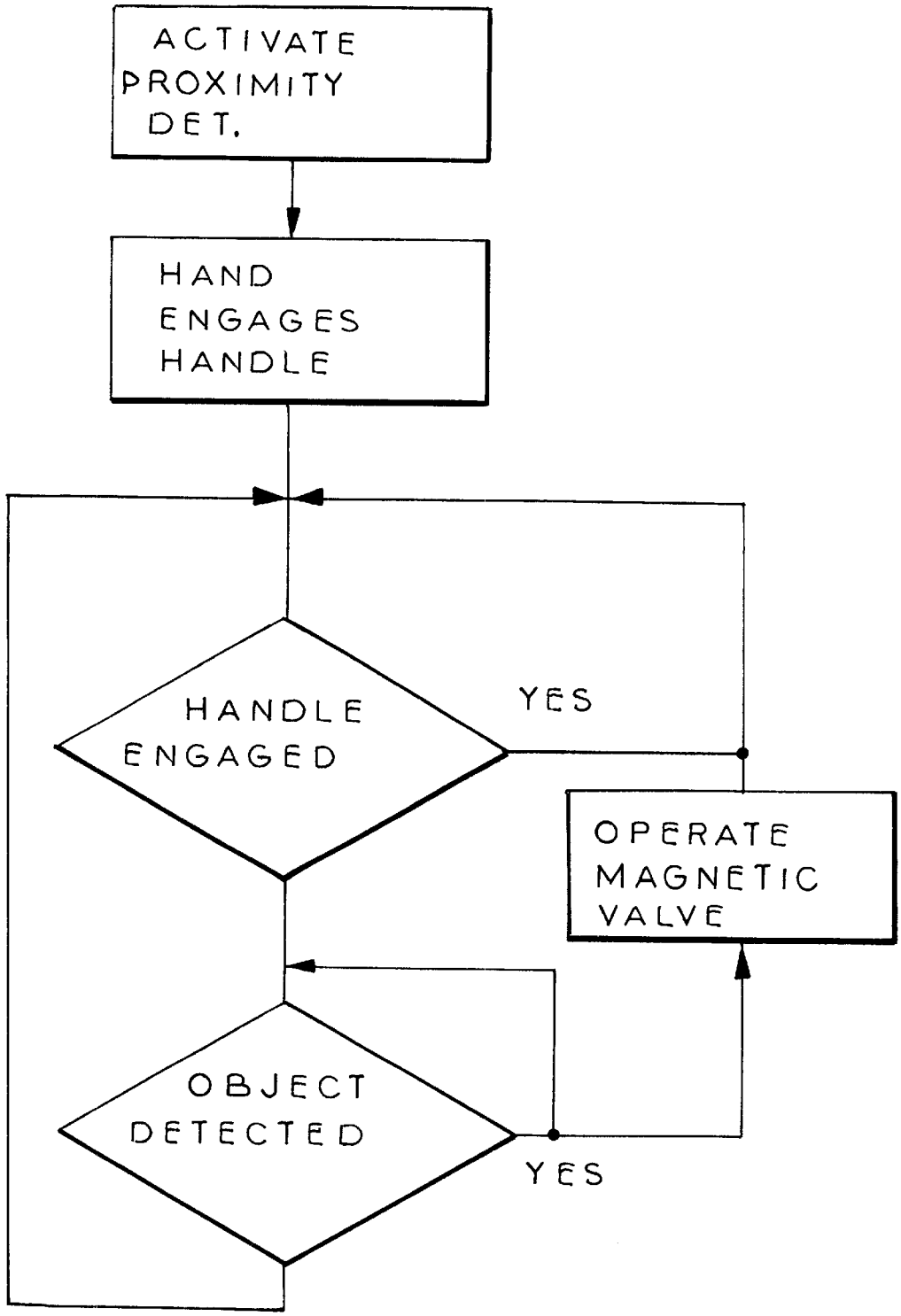
FIG. 2 is a diagram illustrating the hierarchical relationship of the contact sensor and the proximity detector in operating the pilot valve by the electronic controller.

An information flow diagram is shown in FIG. 2 to depict this operation and the detector is activated at 100 and remains enabled continuously. When the hand engages the handle at 101, the controller detects at 102 this engagement and operates the magnetic valve at 103 or permits detection at 104 of an object in the range of the proximity detector, this latter stage being subordinate.

We claim:

1. A valve system comprising:

a manually controlled valve having a handle for controlling flow between an inlet and an outlet;

an electrically controlled valve hydraulically in series with said manually controlled valve and openable to permit flow through said manually controlled valve and closable to limit flow through said manually controlled valve;

a contactless proximity detector responsive to presence of an object in a vicinity of said manually controlled valve;

a contact sensor responsive to contact of said handle by a hand of a user; and an electronic controller connected to said electrically controlled valve, said proximity detector and said contact sensor and constructed and arranged so that:

said sensor is hierarchically superordinate to said detector and maintains said electrically controlled valve open as long as there is contact with said handle by the hand of the user, said detector is hierarchically subordinate to said sensor and maintains said electrically controlled valve open even in an absence of contact with said handle by the hand of the user, and said detector is continuously activated.

2. The valve system defined in claim 1 wherein the manually-controlled valve is a single-lever mixing and flow control valve.

3. The valve system defined in claim 1 wherein the electrically-controlled valve is an electromagnetically-operated pilot valve.

4. The valve system defined in claim 1 wherein the electrically-controlled valve is provided upstream of said manually-controlled valve.

5. The valve system defined in claim 4 wherein the electrically-controlled valve comprises a pair of valves connected respectively in hot and cold water lines running to said manually-controlled valve.

6. The valve system defined in claim 5 wherein said pair of valves are formed in a single body as a twin valve for the hot and cold water, operated by a pilot valve member.

7. The valve system defined in claim 4 wherein each of said valves of said pair of valves is provided with a check valve preventing backflow.

8. The valve system defined in claim 4 wherein each of said pair of valves is provided with a screen for removing contaminants from water flowing therethrough.

9. The valve system defined in claim 7 wherein each of said pair of valves is provided with a screen for removing contaminants from water flowing therethrough.

10. The valve system defined in claim 1 wherein said manually-controlled valve is a single-lever faucet for a sanitary fixture controlling water flow and water temperature by mixing hot and cold water, said contact sensor being located on said handle, said contactless proximity detector being located in a valve housing for said manually-controlled valve on said sanitary fixture.

* * * * *